United States Patent [19]

Reisacher

[11] 4,023,547

[45] May 17, 1977

[54] RECIPROCATING-PISTON-TYPE INTERNAL COMBUSTION ENGINE PARTICULARLY FOR THE OPERATION OF PASSENGER AUTOMOBILES

[76] Inventor: Josef Reisacher, Weinstrasse, 18 Ostring, Kirchheim, Germany

[22] Filed: Aug. 6, 1975

[21] Appl. No.: 602,251

[52] U.S. Cl. ..... 123/196 R; 123/195 R; 184/6.5

[51] Int. Cl.[2] ..... F01M 1/00

[58] Field of Search ..... 184/6.5; 123/196 R, 123/195 R

[56] References Cited

UNITED STATES PATENTS

| | | | |
|---|---|---|---|
| 964,637 | 7/1910 | Fornaca | 123/196 R |
| 1,948,340 | 2/1934 | Dolza | 184/6.5 |
| 2,899,015 | 8/1959 | Leach et al. | 184/6.5 |

FOREIGN PATENTS OR APPLICATIONS

| | | | |
|---|---|---|---|
| 877,738 | 9/1961 | United Kingdom | 184/6.5 |

*Primary Examiner*—Ronald H. Lazarus
*Attorney, Agent, or Firm*—Watson, Cole, Grindle & Watson

[57] ABSTRACT

A reciprocating-piston-type internal combustion engine, particularly for the operation of passenger automobiles. The engine includes a cylinder head and a crankcase. The upper portion of the crankcase is integrally casted with the cylinder head. A cavity in the crankshaft is connected with ducts supplying lubricating oil to the bearing surfaces for the connecting rods and to the bearing surfaces of the main bearings.

4 Claims, 3 Drawing Figures

RECIPROCATING-PISTON-TYPE INTERNAL COMBUSTION ENGINE PARTICULARLY FOR THE OPERATION OF PASSENGER AUTOMOBILES

BACKGROUND OF THE INVENTION

The invention relates to a reciprocating-pistontype internal combustion engine, in particular for the operation of passenger automobiles, wherein the cylinder head and the upper portion of the crankcase are integrally casted and the connecting-rod bearings on the crankshaft are supplied with lubrication oil via ducts provided in the crankshaft.

Engines for passenger automobiles are generally operated on a very low percentage of the rated power, particularly in urban areas, on roads or in column traffic. In conjunction with the internal losses of the necessary auxiliary units and such accessories as serve for the increase of comfort, the internal losses of the engine are about the size of this average actual output. Therefore, such measures as tend to avoid loss of power on the engine may be expected to lead to correspondingly high fuel savings. Further fuel economies may result from a reduction of the weight of the engine and from reduced dimensions of the engine.

SUMMARY OF THE INVENTION

Usually connecting-rod bearings withstand three times the load of the main bearings of the crankshaft. It is the purpose of the invention to load the main bearings approximately at the same rate as the connectingrod bearings as a result of which the dimensions of the main bearings could be reduced, provided, however, that the thickness of the lubricating oil is not allowed to diminish. Any reduction of the diameter of the main bearings would produce a sizeable reduction of the bearing friction losses because the latter vary with the fourth power of the bearing diameter, the bearing width remaining unaltered.

According to the invention, in an internal combustion engine of the kind described above the crankshaft main bearings are also supplied with lubricant from the crankshaft. The crankshaft is therefore of a hollow design and is provided with transverse ducts terminating in the bearing surfaces at the bearing supports. The crankcase portion terminates at least in the area of the crankshaft main bearing above the crankshaft bearing support. The crankshaft main bearings are flanged to the crankcase section in the shape of individual bearingblocks with preferably equal upper and lower portions. As a result, the bearing surfaces of the main bearings are no longer interrupted in the principal load areas by lubricating grooves or oil bores. In addition, the oil supply ducts leading to the bearing surfaces of the main bearings can be freely arranged in such a manner that the best lubrication effect possible is achieved as it is with the connecting-rod bearings on the crankshaft. The lubricating oil is always supplied to the most convenient spots of the bearing surfaces, which as a rule is just in front of the main load area. The integral and consequently rigid design of the cylinder head and the upper portion of the crankcase permits a further increase in the supporting capacity of the main bearings since the bearings may be elastically deformable to a limited extent in the principal directions of load. When loaded, the bearing bore joins the shaft journal closely over larger surface areas, thereby increasing the supporting capacity of the oil film. Likewise, a limited elasticity of the bearings in a longitudinal direction of the engine precludes the occurence of high end-pressures.

The above-mentioned measures according to the invention make it possible to considerably reduce the size of the bearing surfaces and consequently, the diameters of the main bearings. As a result not only are the bearing friction losses substantially reduced, but greater compactness of design and therefore a reduction of the weight of the engine are also obtained. Finally, due to the reduction of the diameters of the main bearings, a more favourable flux of force is achieved in the crankshaft, resulting in less stress on the crankshaft, particularly in the grooves between the bearings.

According to another embodiment of the invention, the lubricant can be supplied to the cavity in the crankshaft from a crankshaft main bearing located at the extremities of the crankshaft. For that purpose, this main bearing is provided with an annular groove located on the side of the supporting surface of this bearing, and a tranverse duct permanently connecting the cavity of the crankshaft with this annular groove is provided in the crankshaft. This constitutes a simple and spacesaving solution.

Furthermore, in accordance with the invention, the surface of the crankshaft main bearings may be less than 130 percent of the surface of the connecting-rod bearings, but at least equal to 100 percent of the surface of the connecting-rod bearings, so that the diameters of these bearing surfaces are of approximately equal relationship to one another. Following this rule of dimensioning, the values of the above mentioned advantages will be the most advantageous attainable.

According to a further embodiment of the invention, the upper and lower portions of the bearing blocks can be integrally casted such as of cast-iron or some light-metal alloy and can be sufficiently thin-walled so that their elasticity is about that of the connecting-rod bearing cover. This results in a further increase of the bearing supporting capacity which approaches that of the connecting-rod bearing, with a similar effect also being produced in connection with the dimensions. The design of these easily exchangeable parts offer the additional advantage of saving the cost of comparatively expensive bearing boxes.

BRIEF DESCRIPTION OF THE DRAWINGS

Further details of the invention will be explained with reference to an embodiment of the invention wherein.

DESCRIPTION OF THE PREFERRED EMBODIMENT

Figure 1:
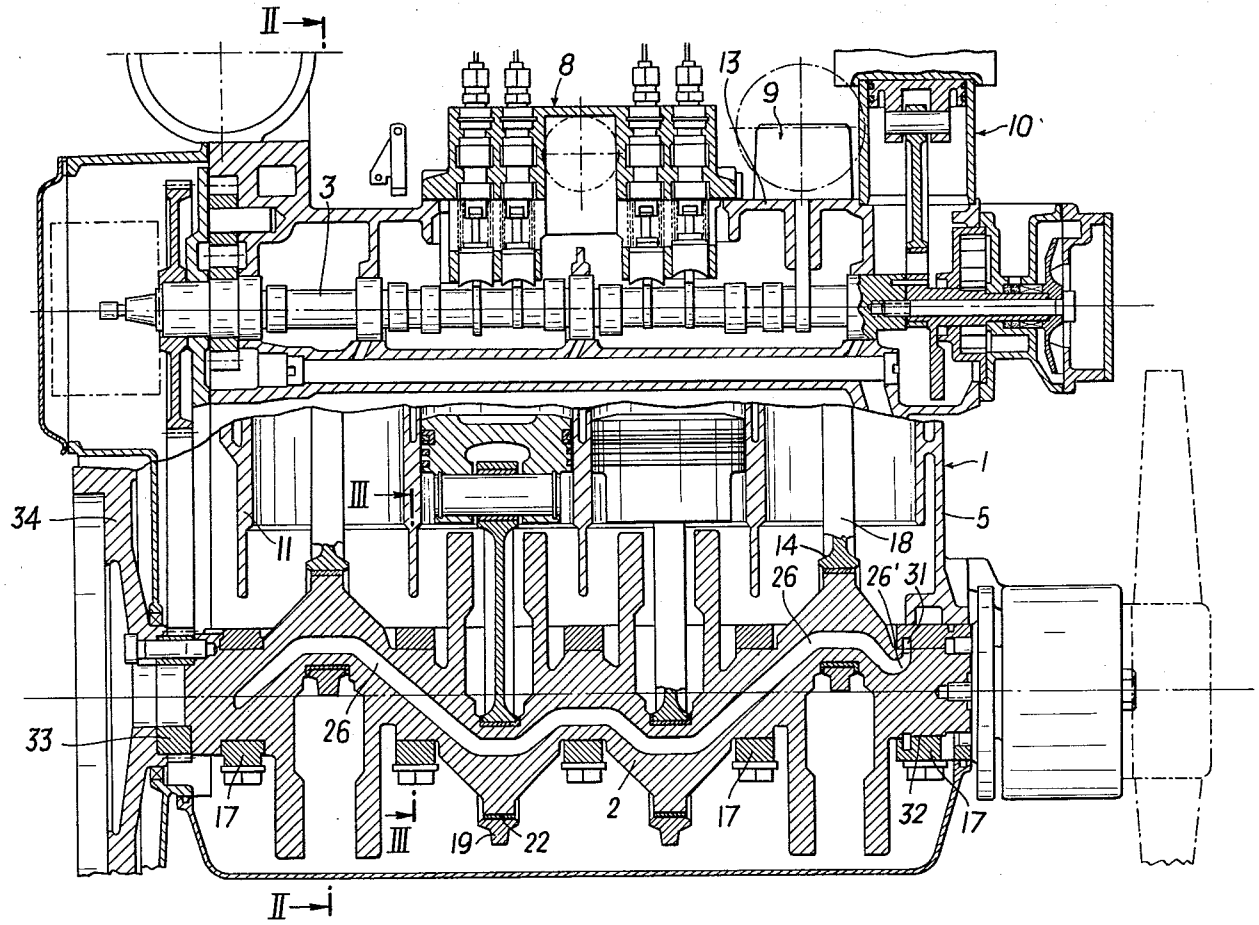
FIG. 1 shows part of an axial cross-section along line I—I of FIG. 2, of a four-cylinder diesel engine according to the invention.
Figure 3:
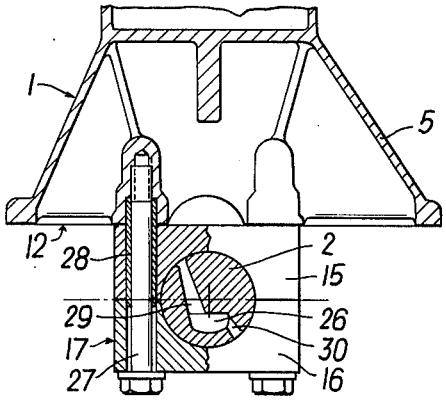
FIG. 3 is a partial cross-sectional view along line III—III of FIG. 1.
Figure 2:
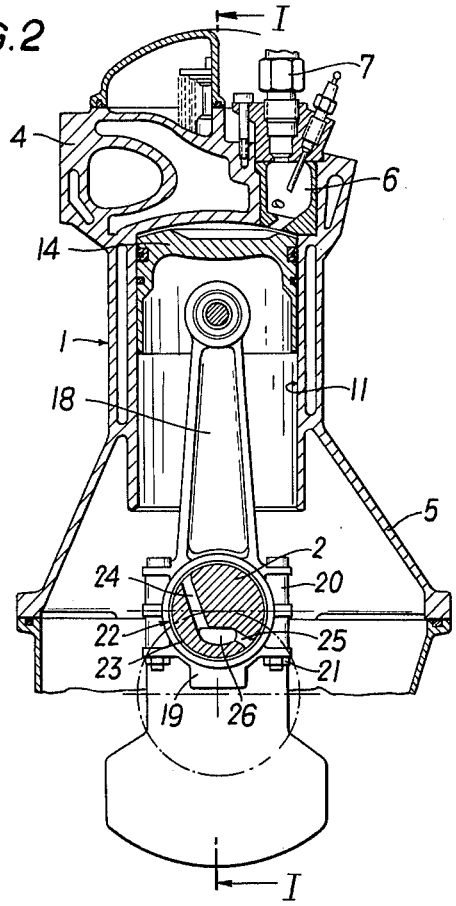
FIG. 2 is a cross-sectional view in perpendicular relationship to the former along line II—II of FIG. 1.

The four-cylinder diesel engine illustrated in the Figures includes a turbulence chamber designed for horizontal incorporation with a slight inclination. The engine has a cylinder block 1, a crankshaft 2 and a camshaft 3. The cylinder block integrally includes cylinder head 4 and upper portion 5 of the crankcase. In cylinder head 4, turbulence chamber 6 is located. Fuel injection nozzle 7 terminates in chamber 6. Fuel injection pump 8 is operated by means of camshaft 3 and so are other auxiliary apparatus such as the water pump, fuel pump 9, as well as hydraulic accessories, the oil pump and air compressor 10, partly indicated and partly not shown in the drawing. These and other elements which are not essential for the present invention will not be explained in detail here. The cylinder block 1 includes, in addition to cylinder head 4 and the upper portion of crankcase 5, accessory rack 13 which is integrally casted.

The upper portion of the crankcase 5 includes the cylinder bores 11 for pistons 14 and flanging surfaces 12 for bearing blocks 15, 16 of which the latter form main bearings 17. The connecting rods 18 which provide the driving connection between pistons 14 and crankshaft 2 are of conventional design. Connecting-rod bearings 22 are divided at the crankshaft and bearing caps 19 as well as the complementary bearing members 20 on the connecting rod 18 are of a comparatively elastic design so that these members, held together by means of screws 21, closely adjoin the crankpin of the crankshaft 2 when under load. The connecting-rod bearing 22 includes a bushing 23 the inner surface of which forms the sliding surface for the crankpin and is supplied with lubricating oil from cavity 26 in crankshaft 2 through ducts 24 and 25.

In the main bearings 17, the crankshaft 2 presents approximately the same diameter as in connecting-rod bearings 22. The main bearings are formed by bearing blocks the upper portion 16 and lower portion 15 of which have the same basic shape. The bearing blocks are attached to surfaces 12 of the upper portion of crankcase 5 by means of set screws 27 with the aid of fitting bushes 28. The two component parts of bearing blocks 15, 16 are made of castiron or a light-metal alloy, for example, and preferably have a degree of elasticity of the order of that of the connecting-rod bearing covers 19. No bearing bushes are provided. The lubricant is not supplied from the outside as with the conventional design, but in the same manner as with the connecting-rod bearing at the crankshaft through ducts 29 and 30 which constitute the connection with the cavity 26 in the crankshaft.

The crankshaft is of hollow design and can be manufactured by means of high-quality casting with ceramic cores with precast oil ducts and a grinding addition at the bearing supports. Although the cost of a high-quality blank is probably higher than that of a wrought-iron blank, the expense involved in the mechanical processing of the crankshaft is considerably reduced. Another major advantage resides in the fact that the preferably identical upper and lower portions of the bearing blocks can be readily exchanged.

The lubricating oil is supplied to cavity 26 of crankshaft 2 through a transverse duct 26' and an annular groove 31 located in close vicinity of the supporting surface 32 of the end of bearing 17 of crankshaft 2 (see FIG. 1 of the drawing, right-hand side). The cavity 26 of the crankshaft which delivers lubricating oil to all the bearings terminates in the area of the end of bearing 17 of the crankshaft (left-hand side of FIG. 1 of the drawing). At this end of the crankshaft, gear wheel 33 for the operation of the camshaft and flywheel 34 are also attached.

I claim:

1. A reciprocating-piston-type internal combustion engine comprising:

a cylinder head;

a crankcase having an upper portion integrally casted with said cylinder head;

a plurality of main bearings having first bearing surfaces, each of said main bearings including a bearing block having similar upper and lower portions;

a crankshaft mounted within said main bearings and having second bearing surfaces;

connecting rods supported on said second bearing surfaces of said crankshaft;

said crankshaft having ducts through which lubricating oil is supplied to said second bearing surfaces for the connecting rods and additional ducts terminating at said first bearing surfaces of said main bearings and serving for the supply of lubricating oil to said first bearing surfaces;

said crankshaft further having a cavity extending at least from one end to the other end of said main bearings and connected with said ducts leading to said second bearing surfaces for said connecting rods and to said first bearing surfaces of said main bearings;

a stationary annular groove located in the vicinity of one of said first bearing surfaces of said main bearing at one end of said crankshaft and being supplied with lubricating oil;

said crankshaft having a further duct permanently connecting said cavity of said crankshaft with said annular groove;

said crankcase having a surface of attachment on its upper portion, said attachment surface terminating in the area of said second bearing surfaces above said crankshaft; and, said bearing blocks being flanged to said attachment surface.

2. A reciprocating-piston-type internal combustion engine as claimed in claim 1, wherein the bearing surfaces of the main bearings of the crankshaft are of a size between 130 and 100 percent of the bearing surfaces for the connecting rods.

3. A reciprocating-piston-type internal combustion engine as claimed in claim 1, wherein the connecting rod has a bearing elastically deformable to a limited extent in the principal directions of load and said upper and lower portions of the bearing blocks forming the main bearings of the crankshaft are integrally casted and so thin-walled that their elasticity is of the order of the elasticity of the bearing of the connecting rod on the crankshaft.

4. A reciprocating-piston-type internal combustion engine as claimed in claim 3, wherein the bearing blocks are formed of a light-metal alloy.

* * * * *